US005899468A

United States Patent [19]

Apps et al.

[11] Patent Number: 5,899,468

[45] Date of Patent: May 4, 1999

[54] ORGANIC WASTE CART WITH VENTED LID

[75] Inventors: William Patrick Apps, Alpharetta, Ga.; Gabriel Antonio Gurra, Walnut, Calif.

[73] Assignee: Rehrig Pacific Company, Los Angeles, Calif.

[21] Appl. No.: 08/887,238

[22] Filed: Jul. 2, 1997

[51] Int. Cl.[6] ..... B65D 1/38

[52] U.S. Cl. ..... 280/47.26; 220/371; 220/373

[58] Field of Search ..... 280/47.26, 47.17; 220/371, 372, 373, 908, 909

[56] References Cited

U.S. PATENT DOCUMENTS

| | | | |
|---|---|---|---|
| 4,127,216 | 11/1978 | Martin, Jr. et al. | 220/373 |
| 4,315,579 | 2/1982 | Martin, Jr. | 220/371 |
| 4,541,544 | 9/1985 | Martin, Jr. et al. | 220/373 |
| 5,031,796 | 7/1991 | Schafer et al. | 220/371 |

FOREIGN PATENT DOCUMENTS

| | | | |
|---|---|---|---|
| 4002-174 | 4/1991 | Germany | 280/47.26 |
| 3936-099 | 5/1991 | Germany | 280/47.26 |

*Primary Examiner*—Robert J. Oberleitner
*Assistant Examiner*—Clovia Hamilton
*Attorney, Agent, or Firm*—George W. Finch

[57] ABSTRACT

Vent structures are provided on the upper and lower sides, and lid of an organic waste cart so that wet biomass deposited in the cart is dried by convective air currents passing through the cart. The lid vent is hooded to prevent moisture from passing into the biomass. A perforated false bottom within the cart elevates the biomass above the lower vents to assure that drying air can circulated throughout the biomass.

7 Claims, 5 Drawing Sheets

ORGANIC WASTE CART WITH VENTED LID

BACKGROUND OF THE INVENTION

The transport and elimination of biomass such as grass clippings, leaves, twigs and other residential organic debris traditionally has been accomplished by placing the debris in plastic bags or trash cans for pickup at the curb. As residential users of trash pickup services have become more sophisticated, the use of plastic bags has raised environmental concerns about adding unneeded plastic to landfills. Back injuries occurring when residential trash cans of various weights are manually lifted have driven municipalities and trash pickup services to automated trash pickup trucks, which usually require specially constructed waste containers. Normally these waste containers are constructed from plastic material and have a hinged lid, a handle, and wheels so that a residential user can easily position the waste cart at the curb for proper engagement with automated lifting machinery on the trash truck. In some locations, residential users are required to separate their trash into paper, plastic, garbage and organic biomass.

Wet biomass is particularly difficult to handle in an automated waste collection environment because it tends to stick within the waste cart, and the moisture therein makes compression difficult and increases the overall weight per unit volume of the biomass, resulting in more trash truck trips to the incinerator, dump, or landfill.

Therefore there has been a need to provide an organic waste cart, which can interface with automated lifting equipment on trash trucks and which facilitates the drying of biomass deposited therein during the time the biomass is contained therein.

SUMMARY OF THE INVENTION

In the present invention, a wheeled waste cart is provided with a hinged perforated false bottom, which allows air circulation through lower vents up through the false bottom, any wet biomass contained therein, and out the top of the cart with most moisture going out through a hooded vent in the hinged lid. The lid vent is hooded so that inclement weather does not add to the moisture within the waste cart while the opening is blocked by a perforated plate to keep vermin out of the waste cart. The drying process is assisted by heat, generated either by rotting of the biomass or solar energy absorbed through the sides and lid of the cart. The absorption of solar energy can be enhanced by coloring the cart black or dark green. The heat causes convective air flow, which draws dry air in through the lower vents at the bottom sides of the cart. The dry air flows upwardly through the wet biomass and out the lid vent and optional upper vents in the upper sides of the cart, carrying moisture with it.

The present organic waste cart can be totally constructed from moldable plastic materials, which are not susceptible to rust or corrosion in the moist environment in which its use is intended. The cart is robust so that it can be handled by automated lifting equipment, easily adapted to be manufactured using common modes that are used to form non-vented waste carts, and repairable should accidental overloads result in the loss of component parts from the cart.

Is therefore and object of the present invention to provide an improved organic waste cart, which can promote drying of organic waste therein even in a relatively moist environment.

Another object is to optimize the drying airflow from bottom to top in an organic waste cart.

Another object is to provide a hooded vent on the lid of a waste cart amenable to automated pickup, which prevents rain from entering the cart through the lid.

These and other objects and advantages will become apparent to those skilled in the art after considering the following detail specification together with the accompanying drawings wherein.

DETAILED DESCRIPTION OF THE SHOWN EMBODIMENT

Figure 1:
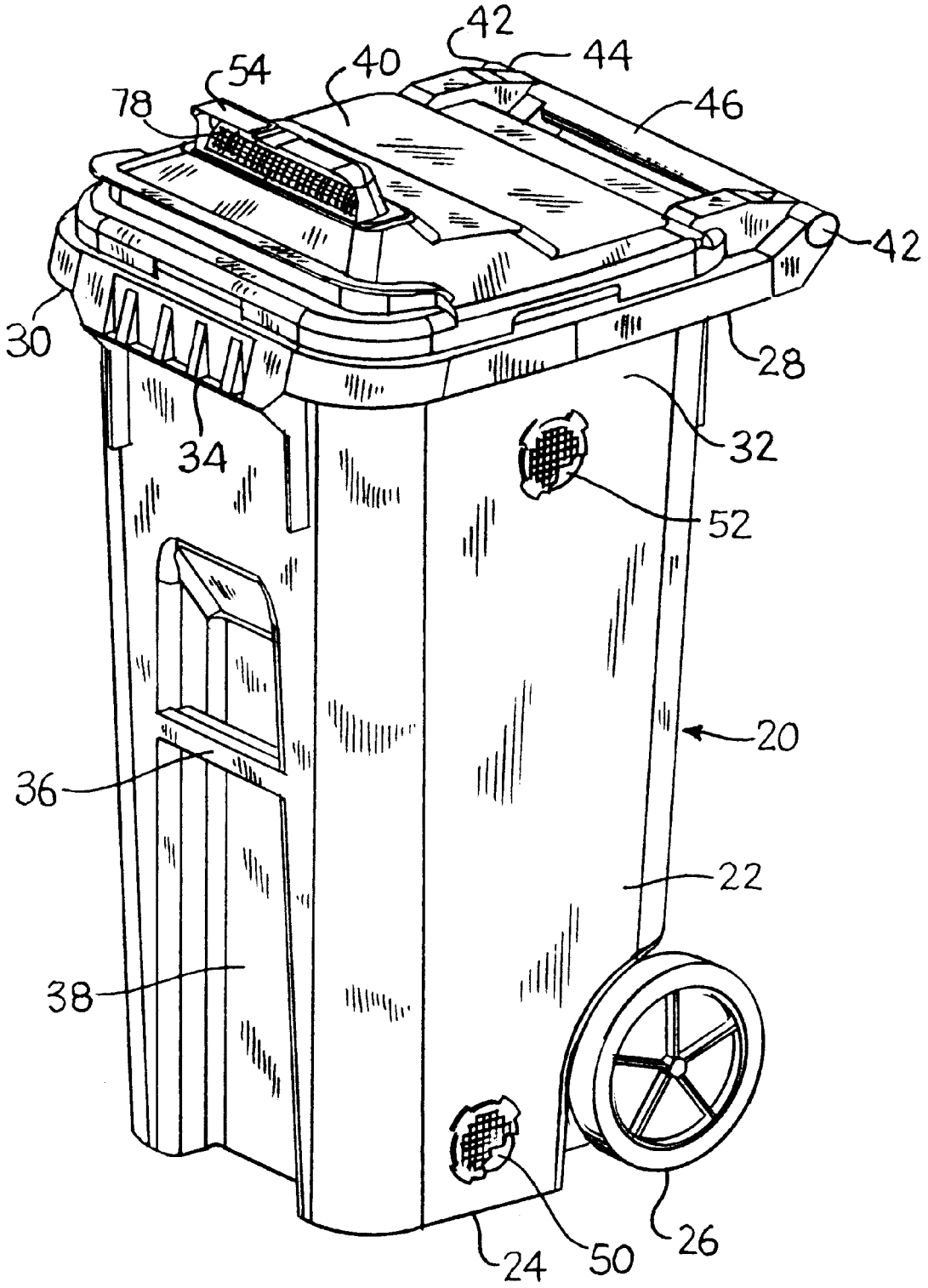
FIG. 1 is a perspective view of the exterior of a waste cart constructed according to the present invention.

Referring to the drawings more particularly by reference numbers, number 20 in FIG. 1 refers to an organic waste cart constructed according to the present invention. The cart 20 includes a hollow body 22 supported on the ground by a base 24 and a pair of wheels 26 suitably attached to the body 22 for rotation. The body 22 includes upper ledges 28 and 30 about its upper end 32, a front ledge 34, and a molded handle 36 across reinforcing indentation 38, all of which can be used to interface with automated cart lifting equipment on a trash truck, not shown.

The body 22, also includes a lid 40 hinged to the upper end 32 by a pair of axle pins 42 extending through hinge portions 44 of the lid 40 and into a handle structure 46. When the cart 20 is lifted and tilted forward, the lid 40 opens under the influence of gravity so that anything contained within the cart 20 can be dumped. Since the cart 20 is intended for storage and disposal of organic waste, which may contain excessive moisture, vents 50 are provided near the base 24 to allow inflow of air whereas vents 52 and hooded lid vent 54 allow outflow of moist air so that any biomass inside the body 22 gets dried.

Figure 2:
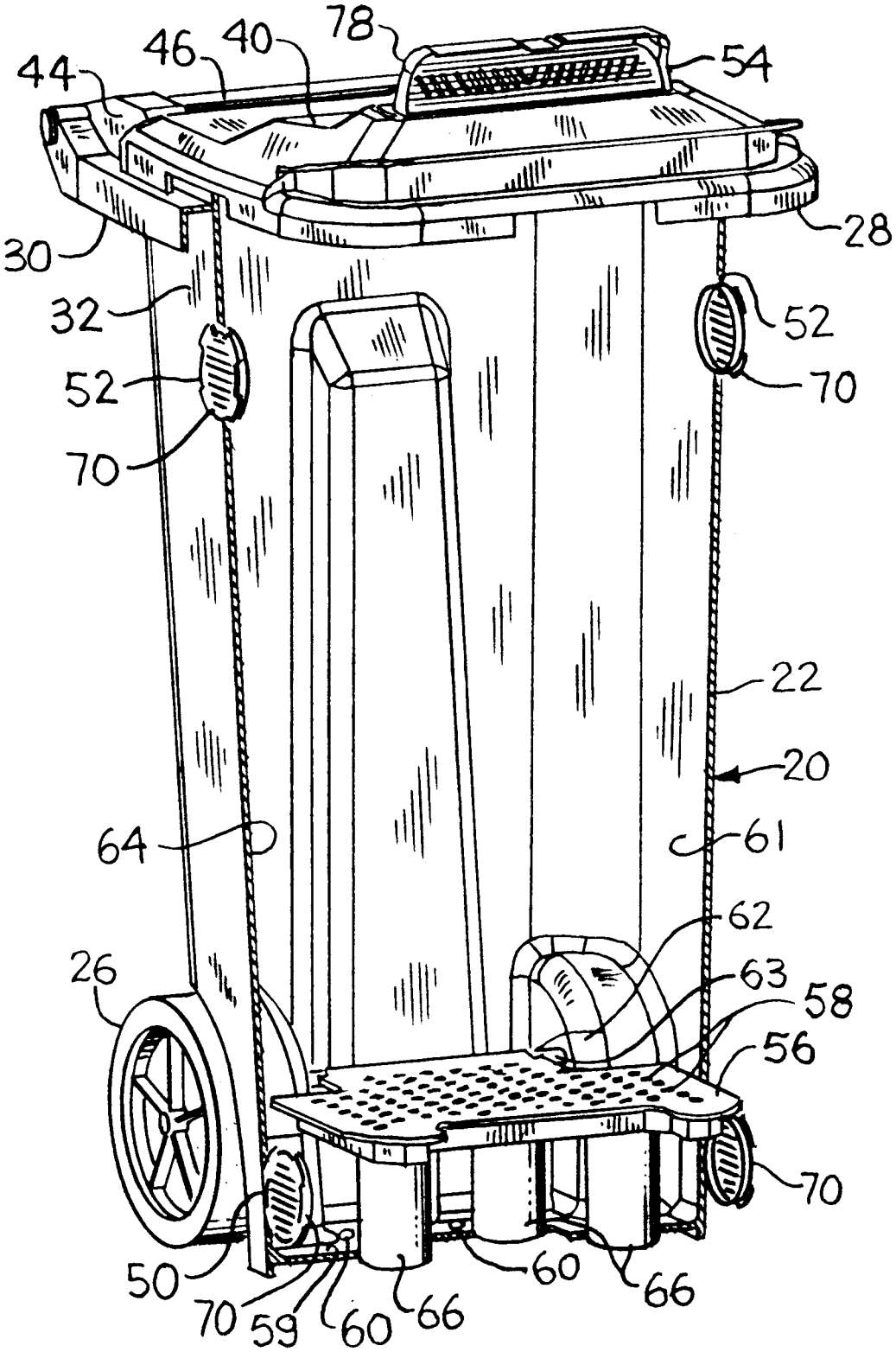
FIG. 2 is a partial cross sectional view of the organic waste cart of FIG. 1 showing the interior details thereof.

As can be seen with reference to FIG. 2, a false bottom or drying plate 56 having perforations 58 there through is used to support biomass away from the bottom 59 of the waste cart 20. The bottom 59 may include one or more drain holes 60 to prevent puddles of moisture accumulating when extremely wet biomass is deposited within the cart 20. The false bottom 56 includes hinged pins 62, which engage suitable inner receptacles 63 extending inwardly from the interior wall 64 so that the false bottom 56 can rotate upwardly. Therefore, as the waste cart 20 is rotated for dumping, the false bottom 56 rotates upwardly to prevent any debris there underneath from becoming trapped. As can be seen, the false bottom 56 is supported from the bottom 59 by a plurality of plastic hollow cylinders 66, a shape chosen for strength, ease of molding, and one unlikely to trap debris. Generally the cylinders 66 hold the false bottom 56 parallel to the ground when the cart 20 is in its normal waste containing position so the vents 50 can supply air underneath the false bottom 56, which air rises through the perforations 58 to dry any biomass contained in the cart 20 and then exit the vents 52 and 54.

Vents 50 and 52 are covered by identical replaceable perforated plates 70, with the vents 52 being located beneath the ledges 28 and 30 so that they do not interfere with automated lifting equipment. The vent 54 is used to prevent moisture accumulation underneath the lid 40 and to assure that all rising moist air can escape the cart 20.

Figure 3:
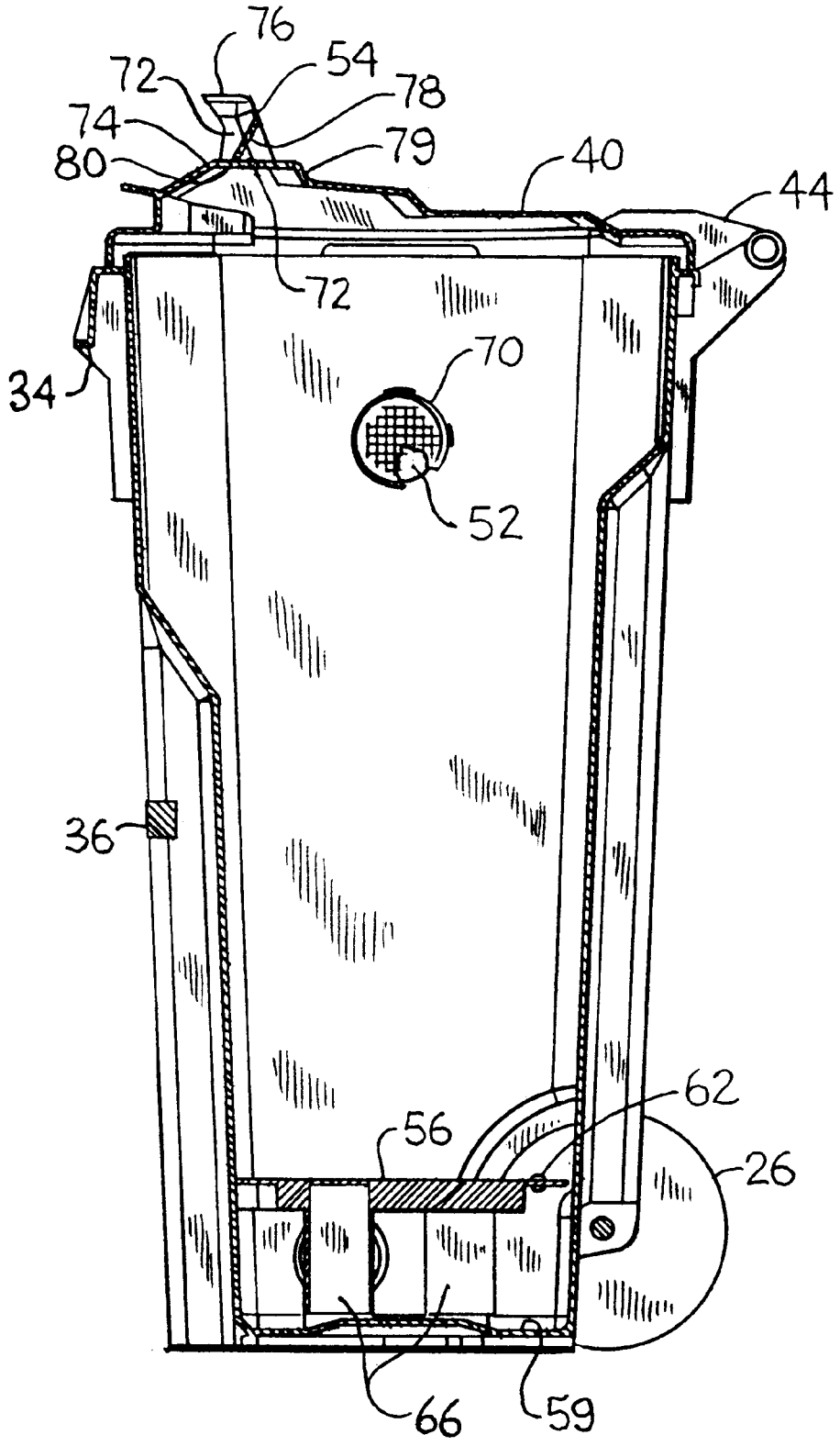
FIG. 3 is a side elevational cross sectional view through the waste cart of FIGS. 1 and 2.
Figure 4:
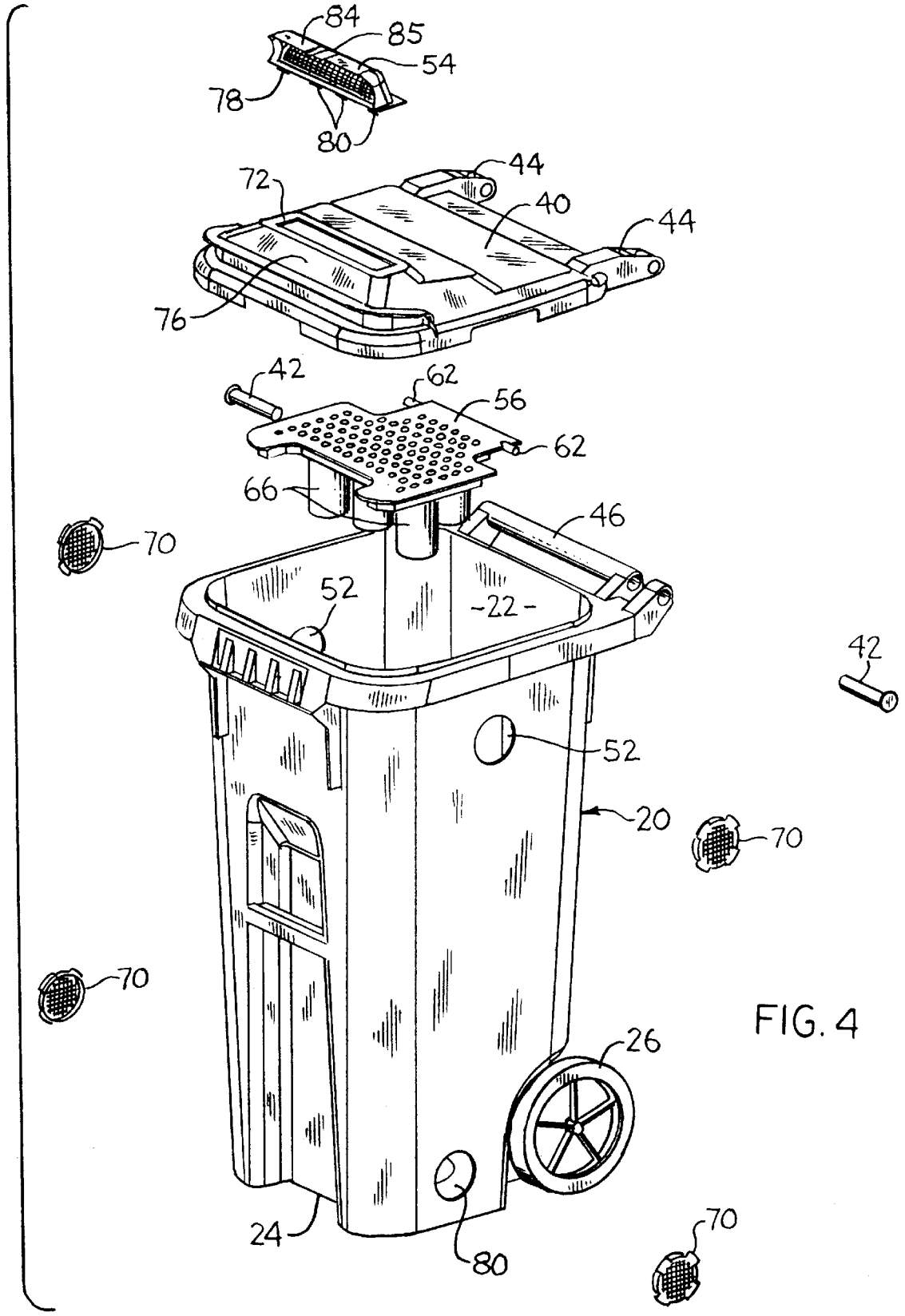
FIG. 4 is an exploded perspective view of the major components of the waste cart of FIGS. 1, 2, and 3.
Figure 5:
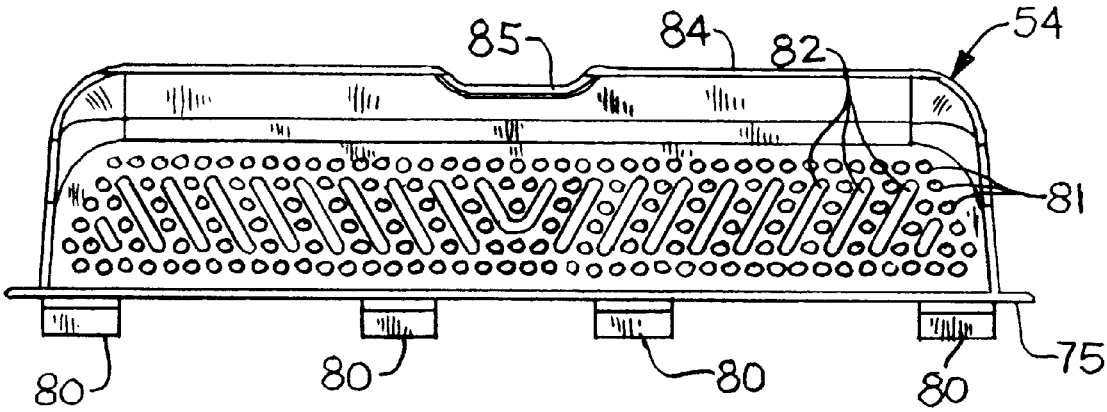
FIG. 5 is a front elevational view of the detachable vent structure of FIGS. 1 through 4.
Figure 6:
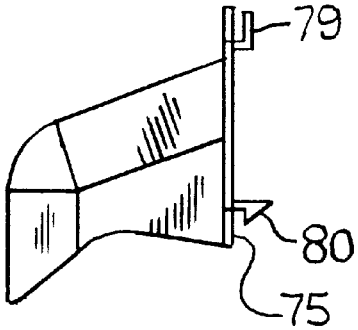
FIG. 6 is a side view of the vent structure of FIG. 5.

As can be seen in FIGS. 3 and 4, the hooded lid vent 54 fits in a vent hole 72 formed through a flat surface 74 of the lid 40. The hooded vent 54 is a unitary member having a downwardly facing abutment surface 75 for contact with the lid 40 about the vent hole 72 and an upper hood portion 76 defining a sidewardly facing opening 77 and covering a perforated vent plate 78 positioned about 45° to normal horizontal in the opening 77 so that rain cannot pass through the vent plate 78 and into the interior of the cart 20, yet moisture does not become trapped by the vent plate 78. Enlarged detailed views of the hooded lid vent 54 are shown in FIGS. 5 and 6. The vent 54 is retained to the lid 40 by a plurality of "L" shaped retainer members 79 and a plurality of arrowhead shaped catch members 80, all of which face outwardly to engage the lid 40. The "L" shaped retainer member 79 retain the vent 54 to the lid 40 with the abutment surface 75 in contact with the lid 40, while the catch members 80 allow the vent 54 to be snapped into place covering the vent hole 72.

As shown in FIG. 5, the vent plate 78 has perforations consisting of vent holes 81, linear slots 82 and a V-shaped slot 83. The perforation configuration is primarily decorative with any suitable perforation pattern being satisfactory. The upper surface 84 of the hooded lid vent also includes a reinforcing groove 85 to make it more robust. Being a separate part, the vent 54 can be molded easily and yet securely retained to the lid 40 by the L shaped members 79 and catches 80.

Thus there has been shown and described a novel organic waste cart with vent structures, which fulfills all of the objects and advantages sought therefor. Many changes, alterations, modifications and other uses and applications of the subject invention will become apparent to those skilled in the art after considering the specification together with the accompanying drawings. All such changes, alterations and modifications that do not depart from the spirit and scope of the invention are deemed to be covered by the invention, which is limited only by the claims that follow.

I claim:

1. A waste cart that enables the drying of moist waste therein including:

a hollow body having:
- a lower portion;
- an upper portion defining:
  - an opening for loading and unloading waste from said hollow body; and
- at least one vent hole in said lower portion; and a lid for closing said opening for loading and unloading waste from hollow body, said lid including:
- at least one lid vent there through, including:
  - a vent hole in said lid; and
  - a hood covering said lid vent hole, including:
    - a generally horizontal hood portion;
    - a sidewardly facing opening in said hood covered with respect to falling rain by said hood portion;
    - a perforated plate covering said sidewardly facing opening; and
    - a reinforcing groove centrally located in said hood at a right angle to said perforated plate, whereby air can convect through said at least one vent hole in said lower portion, through any waste contained in the hollow body and out said lid vent carrying moisture therewith.

2. A waste cart that enables the drying of moist waste therein including:

a hollow body having:
- a lower portion;
- an upper portion defining:
  - an opening for loading and unloading waste from said hollow body; and
- at least one vent hole in said lower portion; and a lid for closing said opening for loading and unloading waste from hollow body, said lid including:
- at least one lid vent there through including:
  - a vent hole in said lid; and
  - a hood positioned over said lid vent hole to shield said vent hole from down falling moisture, whereby air can convect through said at least one vent hole in said lower portion, through any waste contained in the hollow body and out said lid vent carrying moisture therewith, wherein said hood covering said lid vent hole includes:
    - an abutment surface for contacting said lid about said lid vent hole;
    - at least one L shaped retainer member to hold said hood to said abutment surface; and
    - at least one catch member opposite said at least one L shaped retainer member to releasably retain said hood to said lid.

3. The waste cart as defined in claim 2 wherein said hood covering said lid vent hole further includes:

a generally horizontal hood portion;

a sidewardly facing opening in said hood; and a perforated plate positioned in said sidewardly facing opening.

4. A waste cart that enables the drying of moist waste therein including:

a hollow body having:
- a lower portion;
- an upper portion defining:
  - an opening for loading and unloading waste from said hollow body; and
- at least one vent hole in said lower portion; and a lid for closing said opening for loading and unloading waste from hollow body, said lid including:
- at least one lid vent there through including:
  - a vent hole in said lid;
  - a hood positioned over said lid vent hole to shield said vent hole from down falling moisture, whereby air can convect through said at least one vent hole in said lower portion, through any waste contained in the hollow body and out said lid vent carrying moisture therewith;

a perforated false bottom positioned in said hollow body above said at least one vent hole in said lower portion to allow air circulation under waste retained above said false bottom, wherein said lid vent hole including:
- an abutment surface for contacting said lid about said lid vent hole;
- at least one L shaped retainer member to hole said hood to said abutment surface;
- at least one catch member opposite said at least one L shaped retainer member to releasably retain said hood to said lid;
- a generally horizontal hood portion;

a sidewardly facing opening in said hood covered with respect to falling rain by said hood portion; and a perforated plate located in said sidewardly facing opening at about 45° to said generally horizontal hood portion.

5. A waste cart that dries moist waste therein including:

a hollow body having:

a lower portion;

an upper portion defining:

an opening for loading and unloading waste from said hollow body;

at least one vent hole in said lower portion; and at least one vent hole in said upper portion; and a lid for closing said opening for loading and unloading waste from hollow body, said lid including:

at least one lid vent there through, whereby air can convect through said at least one vent hole in said lower portion, through waste contained in the hollow body and out said lid vent carrying moisture therewith, whereby moisture does not accumulate under said lid, said at least one lid vent including:

a vent hole in said lid; and a hood covering said lid vent hole including:

an abutment surface for contacting said lid about said lid vent hole;

at least one L shaped retainer member to hold said hood to said abutment surface; and at least one catch member opposite said at least one L shaped retainer member to releasably retain said hood to said lid.

6. The waste cart as defined in claim 5 wherein said lid is hingedly connected to said hollow body.

7. The waste cart as defined in claim 5 further including:

a least one vent hole in said upper portion of said hollow body; and a plurality of perforated vent covers positioned over said at least one vent hole in said lower portion of said hollow body and said at least one vent hole in said upper portion of said hollow body.

* * * * *